United States Patent [19]

Block

[11] Patent Number: 4,887,372

[45] Date of Patent: Dec. 19, 1989

[54] SHALLOW ANGLE FURROW REFURBISHING METHOD AND APPARATUS

[75] Inventor: Donald P. Block, Clermont, Fla.

[73] Assignee: Orange Service Company, Inc., Orlando, Fla.

[21] Appl. No.: 230,027

[22] Filed: Aug. 9, 1988

[51] Int. Cl.[4] ..... E02F 5/08

[52] U.S. Cl. ..... 37/91; 172/49.5; 37/80 A; 37/195

[58] Field of Search ..... 172/49.5, 111; 37/81, 37/80 A, 82, 99, 189, 91

[56] References Cited

U.S. PATENT DOCUMENTS

| | | | |
|---|---|---|---|
| 1,462,488 | 7/1923 | George | 37/80 A |
| 1,846,902 | 2/1932 | Powell | 37/91 |
| 2,063,584 | 12/1936 | Collins | 97/43 |
| 2,777,272 | 1/1957 | Smith et al. | 56/25.4 |
| 2,875,838 | 3/1959 | McCarty | 172/67 |
| 2,937,463 | 5/1960 | Pougnet | 37/99 |
| 3,115,190 | 12/1963 | Listiak | 172/49.5 |
| 3,328,902 | 7/1967 | Hanson | 37/81 |
| 3,387,436 | 6/1968 | Kasper | 172/49.5 |
| 3,534,817 | 10/1970 | Garis | 172/4 |
| 3,766,672 | 10/1973 | Hanson | 37/91 |
| 3,916,606 | 11/1975 | Brudnak, Jr. et al. | 56/13.4 |
| 4,073,245 | 2/1978 | Anderson | 111/1 |
| 4,178,744 | 12/1979 | Allely et al. | 56/16.2 |

FOREIGN PATENT DOCUMENTS

| | | | |
|---|---|---|---|
| 602692 | 3/1960 | Italy | 37/80 A |

OTHER PUBLICATIONS

Vee TM Mower Sales Brochure.
Dondi Ditcher Sales Literature.

*Primary Examiner*—Richard J. Johnson
*Attorney, Agent, or Firm*—Warren L. Franz

[57] ABSTRACT

Shallow angle furrows between crop beds are reshaped and cleaned in one pass using a tractor-towed implement having angularly even-spaced cutter blades mounted in tiers on drums for rotation about generally vertical axes, perpendicular to the furrow walls on opposing, angularly adjustable decks. The blades of the lower tier are angled to cut into the wall material laterally, parallel to the wall slope, without destroying the root structure of protective sod covering. The cut material is lifted up to the upper tier blades which are offset and lagged so as to eject the cut material up and beyond the furrow wall edges following cutting, in one continuous operation. Plates and pivotal deflectors mounted at the edges of the decks, direct the discharge of cut material. A bell crank and pivotal linkage provides for hydraulically assisted raising and lowering of the apparatus from and into ground contact.

17 Claims, 4 Drawing Sheets

SHALLOW ANGLE FURROW REFURBISHING METHOD AND APPARATUS

This invention relates to a method and apparatus for refurbishing shallow angle furrows, such as for cleaning and reshaping the V-shaped furrows used for drainage between adjacent rows of trees in citrus groves and orchards.

BACKGROUND OF THE INVENTION

It is a common practice to provide furrows for irrigation and/or drainage between beds of agricultural crops or trees for the delivery and/or removal of water. In the cultivation of citrus crops, for example, furrows in the form of shallow angle V-shaped channels are used to drain the beds of adjacent rows of trees in the rainy season. During the winter months, the same furrows are often flooded with water to protect the crops from freeze or frost damage.

Such furrows become clogged with weeds, earth runoff and debris after a period of time and must be cleaned and reshaped. In addition to natural erosion, agricultural equipment, such as pickers and the like, traveling through the furrows leads to their deterioration. Cleaning and reshaping is necessary to permit the free flow of water in the furrow.

Furrows to which the invention relates differ from ditches in that the width-to-depth ratio of the furrows is much greater. The furrows also have considerably shallower wall angles of between 0° -30°from horizontal, whereas the wall angles of ditches are normally on the order of 60°, or more.

A typical furrow arrangement of the type to which the present invention relates is found in citrus groves in South Florida, wherein water furrows are formed in the spacing between single- or double-row beds of citrus trees. Spacing between adjacent trees of neighboring beds is about 30′ from trunk to trunk, with a 6′ growth allowance made for the foliage canopy drip line. The furrow width is thus about 18′, with side walls sloping at an angle of about 10° from horizontal, with 5° to 10° angle slopes being usual and 15° slopes being less common. Natural erosion and equipment tire rut damage disturbs the angle and fills in the furrow bottoms to disrupt lateral water flow. Also, while grass growth is encouraged to withstand wall erosion, weed invasion and overgrowth tends to clog the runoff channels. The result is that the furrows must be mowed about five to six times per year and should be cleaned out and reshaped about once each year. Because of cost and other drawbacks of conventional refurbishing techiques, however, cleaning and reshaping is typically performed only once every three to five years.

Conventional methods employed to clean and reshape the furrows include the use of agricultural plows, discs, blades, and in some locations, road graders. These implements cannot be used when the furrow is wet or has water standing in it. In a typical prior art process, the furrow is first mowed and then tilled to break up the root structure of the sod covering. Discing is then performed to cut transversely into the soil in order to shape out a trench in the furrow bottom leaving a berm partway up each furrow wall. Multiple passes are then made with a blade to displace the berms up the walls toward the tree beds to prevent the relocated soil from washing back down.

Such a process has many disadvantages. The use of different implements in a combination of operations requires several passes over the same ground to achieve proper cleaning and reshaping. This takes time and labor and, consequently, costs money. Transverse cutting during tilling, removes the wall retaining root structure, leaving the furrow unprotected until it can be replaced. The use of plows or blades forms the soil and vegetation into clods that must then be disintegrated and dispersed, usually by a disc. When a disc is used, the soil is left soft and fluffy and, therefore, exceptionally prone to erosion should a heavy rain occur. The upward displacement of the berm, leaves a ridge of soil at the top on both sides of the furrow. This results in undesirable water retention and erosion at the beds. These ridges also cause difficulty in mowing at a later date.

It is desirable to apply a herbicide for weed control immediately after cleaning and reshaping, and also to apply seed and other chemicals to stimulate the growth of the soil retaining sod covering. However, due to the disturbed condition of the soil, this cannot normally be accomplished at once, and a waiting period of one to several weeks is normally necessary before the necessary equipment can be moved through the furrow.

Special V-deck mowers are available for mowing the shallow angle furrows in a single pass. The Vee TM mower available from Orange Service Company, Clermont, Fla., for example, operates off a tractor power take-off (PTO) and has two rotors with adjustable 0°–30° angles (one for each wall), and has a cutting width of 10′ to 12′ and a cutting height of 2″ to 8″. Equipment for refurbishing the furrows in one pass is, however, not available.

Ditchers, such as the doublewheel and monodoublewheel models of Dondi ditchers (available from Impex International, Spartanburg, S.C.) which cut two slopes in one pass of a ditch, are not suitable for cutting shallow angle furrows. The rotating drums of such ditchers are rotated about generally horizontal axes for cutting transversely, almost vertically, into the soil with a perpendicular cut. The width of the cut is too small relative to the depth of the cut, and the resulting ditch wall angles are too steep. The transverse cut destroys the root system of the erosion retarding, soil retention vegetation layer and the cutters cause undesirable balling and rolling of the severed soil and vegetation. Such devices are mounted on tractor three-point lift assemblies which makes them react too abruptly to ground elevation changes for even cutting. The ditchers are, moreover, not angularly adjustable.

SUMMARY OF THE INVENTION

It is an object of the present invention to overcome the above and other drawbacks of the prior art by providing a method and apparatus for refurbishing shallow angle furrows in a single pass and without causing erosion producing conditions.

It is another object of this invention to clean and shape a furrow any time, without concern for the water or moisture condition of the soil, and so as to and permit travel over the area immediately following the shaping operation.

In accordance with the method of the invention, in a single pass longitudinally along the furrow, both furrow walls are simultaneously shaped by cutting them laterally, parallel to their slopes, and delivering the displaced earthen material up and out of the furrow, beyond the furrow wall edges. The apparatus of the invention, usable for practicing the method of the invention, is a tractor-towed implement having cutter blades mounted on drums for rotation about generally vertical axes, perpendicular to the furrow walls on opposing, angularly adjustable decks. The drums are configured to be driven by the tractor power take-off (PTO) in counterrotation and the cutters are arranged in tiers to lift the cut material up and expel it outwardly beyond the furrow walls through adjustable discharge deflectors mounted at the outer edges of the decks.

Refurbishing in accordance with the invention removes only the top layer of vegetation, leaving most of the soil retaining root structure intact. After the furrow has been cleaned and shaped, the soil in the refurbished furrow is packed and smooth. Erosion conditions are minimal and only the vegetation in the central portion of the furrow is removed. Since the root system is mostly intact, vegetation will grow back rapidly to continue protecting the furrow against erosion.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

The principles of the invention are illustrated, by way of example, with reference to a shallow angle furrow system employed in a citrus fruit grove of the type found in South Florida. It will, of course, be appreciated, however, that the invention has application to furrows used in other contexts.

Figure 1:
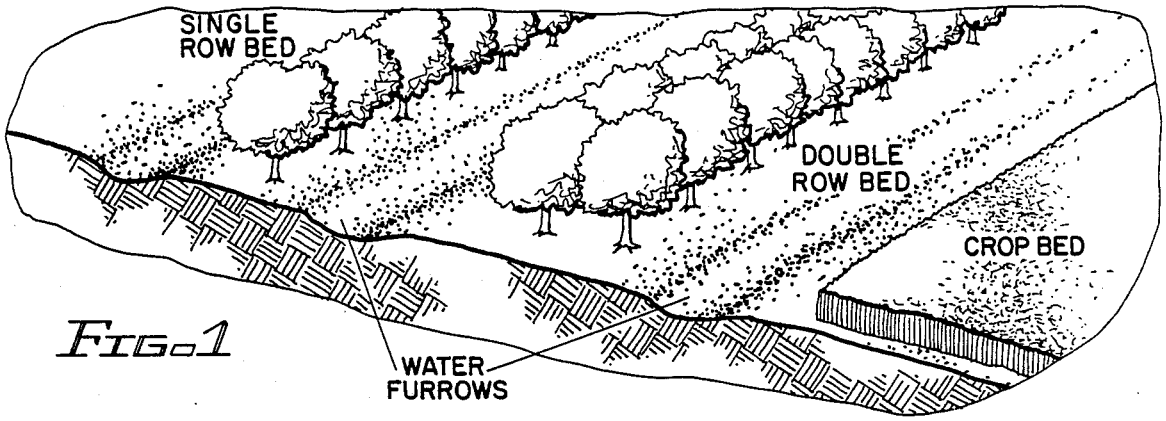
FIG. 1 is a schematic view showing typical shallow angle furrows located between aligned beds of agricultural crops.

With reference to FIG. 1, trees (viz. orange, grapefruit, and other citrus crop trees) of the grove are planted in longitudinally aligned single- or double-row beds separated by clearings in which shallow, wide water furrows 10 are provided, as shown. With double-row beds, the spacing between the rows of trees in the same bed may provide sufficient room for pickers and other agricultural equipment to travel; with single-row plantings the equipment moves in the same spacings occupied by the furrows. To suggest the broader application of the invention, FIG. 1 illustrates one of the furrows running alongside a non-tree crop bed.

The purpose of the furrows in the illustrated grove example is to drain water away from the beds during rainy season and, during winter months, to provide channels that can be flooded with water to protect the crops from freeze or frost damage. To protect the furrows from erosion, grasses are usually planted along the furrow walls. The grass root structure serves to hold the soil in place.

Figure 2:
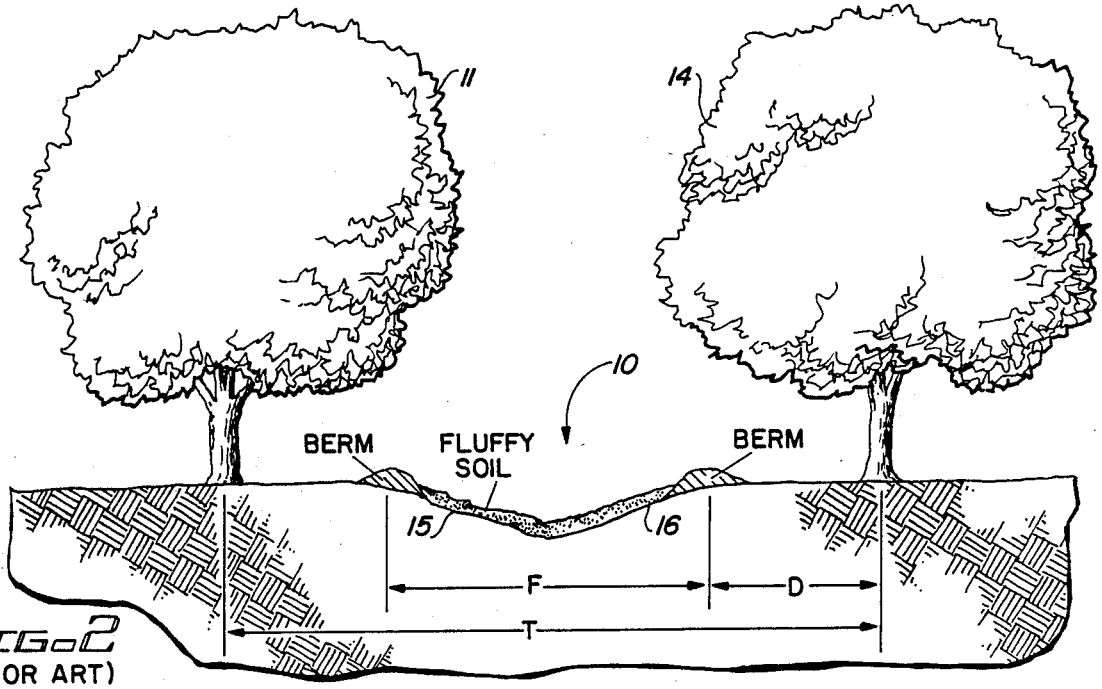
FIG. 2 (PRIOR ART)
FIG. 2 is a schematic view showing a furrow of FIG. 1 after refurbishing in accordance with the prior art.

As seen in FIG. 2, which illustrates the application of prior art refurbishing methods to a furrow 10 of FIG. 1, normal tree spacing "T", trunk-to-trunk, between trees 11, 14 of adjacent beds in such a groove is 27′–35′. Single row tree beds are about 12′ wide to accommodate a tree canopy drip line distance "D" of about 6′ in both directions from the tree trunk which is centrally positioned on the bed. Double beds are appropriately wider to accommodate two laterally spaced trees and optional passageways for agricultural equipment. The furrow 10 is centered in the gap between the beds, extending from drip line to drip line for about 9′ on each side of the furrow centerline, giving a total furrow width "F" of about 18′. The left and right side walls 15, 16 of the furrow 10 are uniformly, oppositely sloped at an angle of from 0° to 30° from horizontal, with the usual angle being about 10°.

Natural soil erosion due to rainfall and water runoff and physical destruction due to equipment moving in the same space, places the furrows in damaged condition, leaving the furrow (and especially the central bottommost portion of the furrow) in need of cleaning and reshaping to restore the original furrow contour for proper water drainage.

In a typical refurbishing operation, attention is focused on cleaning out about 3″–5″ of soil, and in reshaping about 40″ of furrow on each side of the furrow center line.

The prior art approach to furrow cleaning and reshaping utilizes a ditcher or conventional farm implement such as a discer, as discussed above, to cut a trench or ditch centrally in the furrow and then by means of multiple passes with a blade, or similar earth mover, to displace the berms of removed material up the sloped walls to the edges of the furrow. In the process, clodding of earthen material and vegetation that occurs during the cutting step must be broken up. Apart from the added cost and labor expense incurred because of the requirement for many passes over the same ground, and the fact that this central cutting and ground shifting procedure cannot be undertaken on wet ground, the resulting refurbished furrows (see FIG. 2) are left in less than desired condition.

The broken clods result in soft fluffy soil that covers the side walls and will readily wash down again to the center. The berms relocated to the edges of the furrows cause unwanted obstacles at the drip lines to water flowing off the beds. And, the transverse cuts made into the ground by the furrow cutters and ditchers have either removed the protective sod covering completely from a large area of the furrow, or at least broken up the root structure sufficiently, so that soil retention on the furrow walls will be seriously curtailed until the vegetation can be replaced or restored. The method of the invention avoids these drawbacks.

Figure 3A:
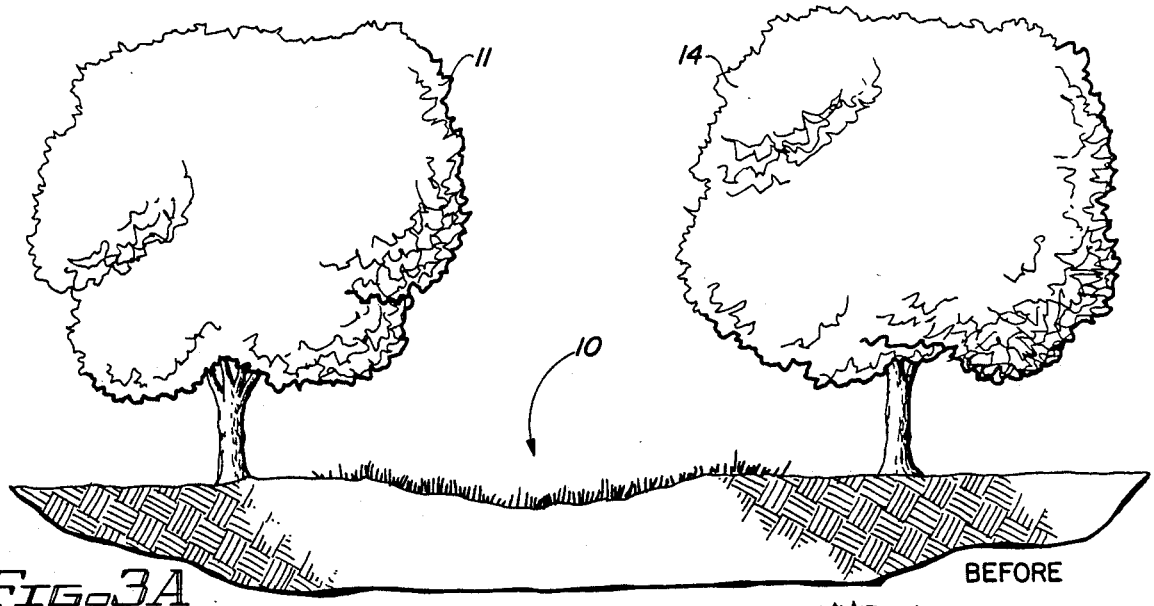
FIGS. 3A–3C are schematic views showing the application of the method of the present invention to refurbish a furrow of FIG. 1.

As a preliminary to undertaking the method of the invention illustrated with reference to FIGS. 3A–3C, the furrow is first mowed as with conventional techniques. Equipment for one-pass mowing may be used, such as the Vee TM mower device, already mentioned, which is commercially available from Orange Service Company, Clermont, Fla. Such equipment has a V-shaped, variable angle deck structure supporting two mower blades, one for each furrow slope. The purpose of the mowing is to prevent weeds and overgrown grass from interfering with the refurbishing operation. The condition of the furrow 10 before refurbishing is begun is shown in FIG. 3A.

Figure 3B:
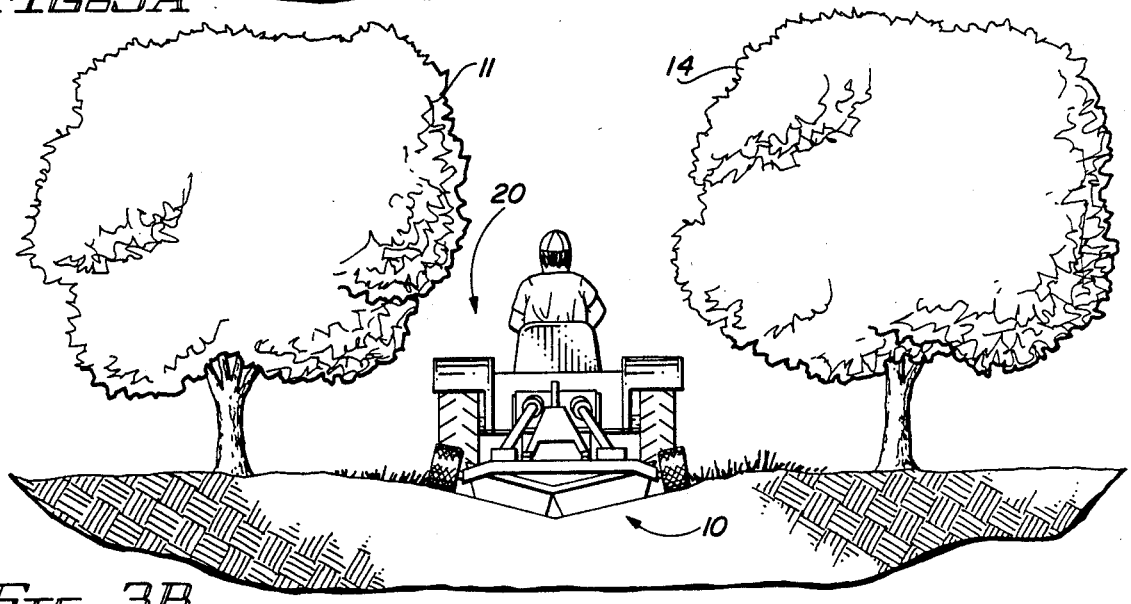
Figure 3C:
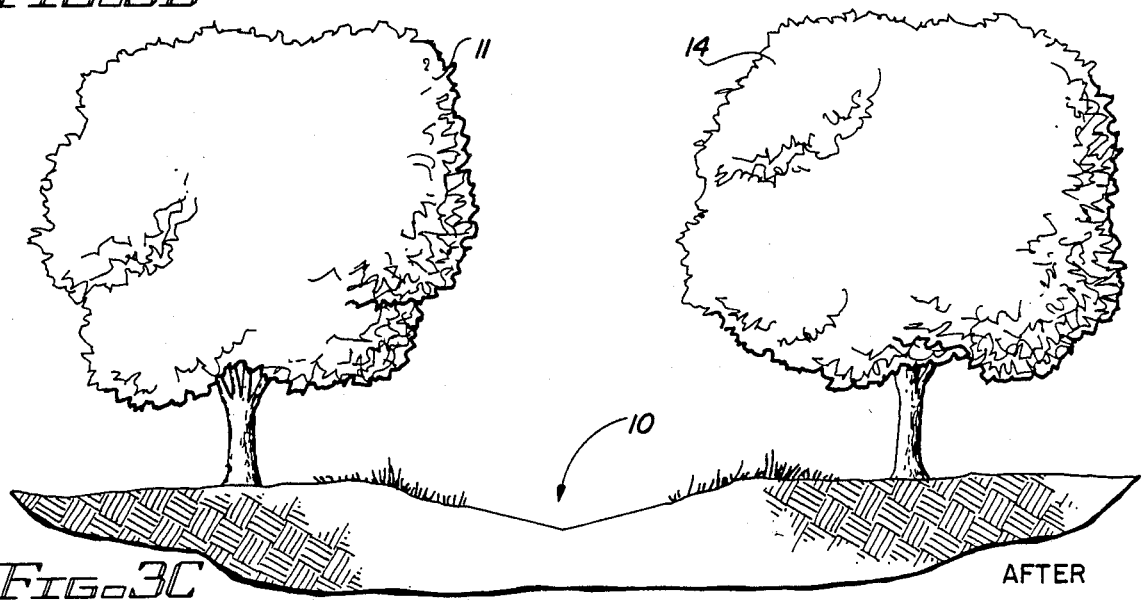

The method of the invention departs from conventional techniques by cutting the central portion of the furrow in a single pass, as shown in FIG. 3B, simultaneously cutting both slopes using lateral, planar cutting blade motions, along paths parallel to the walls of the furrow. The removed earthen material is dispersed upwardly and outwardly from the center of the furrow, beyond the top edges of the slopes and onto the bed, all in one operation following continuously in the same pass with the cutting operation. As a consequence, no berm shifting or removal is necessary. The method completes the refurbishing in a single step, leaving the furrow in renewed condition as shown in FIG. 3C, the ground firm and packed, the removed earthen material widely dispersed under the trees with no flow obstructing berm, and the root structure of the wall covering sod still intact.

FIGS. 4–10 illustrate apparatus 20 in accordance with the invention which is suitable for practicing the method of the invention. The equipment bears a general resemblance to the overall structure of the Vee Mower TM mowing equipment, discussed above, for mowing bedded groves at angles of 0° to 30°, however, with cutter drums located at positions now occupied in the Vee Mower TM apparatus by mower blades. Other differences will become apparent.

As shown in FIGS. 4–8, the apparatus 20 comprises left and right decks 21, 22 oppositely supported for relative angular adjustment about a longitudinal axis of a main support frame 23 which is mountable with a tow bar 25 (described further below), by means of a pin (not shown) fitted into a vertical slot 26 (FIG. 7) at the distalmost end of the bar 25, to the standard draw bar of a conventional tractor, or similar heavy duty towing vehicle. The decks 21, 22 carry left and right cutter drum assemblies 28, 29 (see FIGS. 4–6 and 8), supported on shafts 30 (FIG. 8) pependicularly oriented relative to the decks, and which are respectively coupled to left and right gear boxes 31 of conventional design for rotational movement parallel to the decks, about generally vertical rotary axes.

Figure 8:
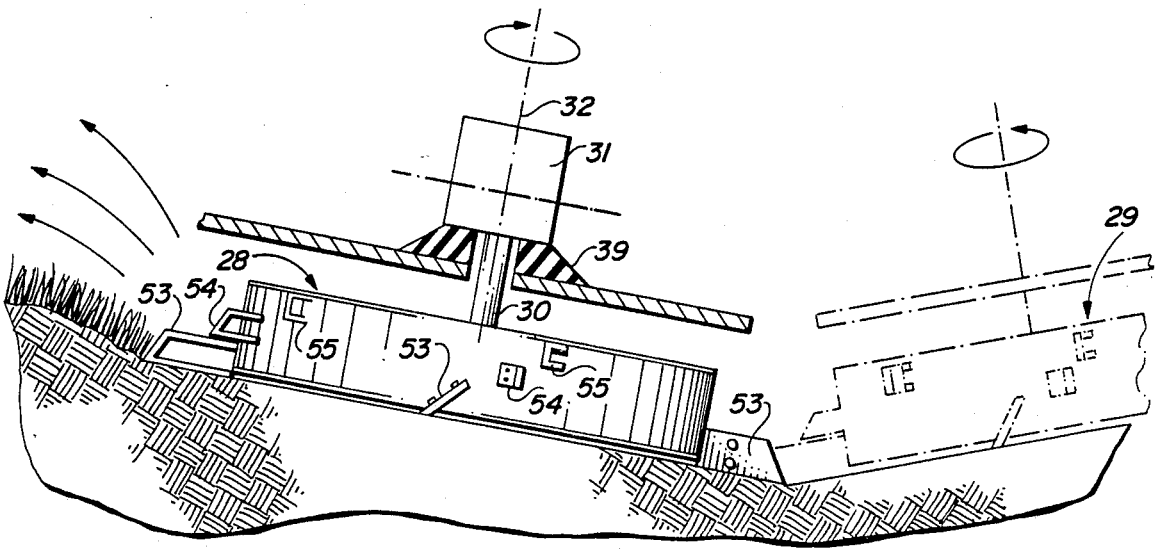
FIG. 8 is an enlarged fragmentary rear view, partially in section, of a cutting drum of the apparatus of FIG. 4.

The frame 23 is supported at its rearward extent by two or more laterally spaced wheels 34 rotationally attached to the extremes of a transversely extending axle frame 35 which is connected for pivoting about a horizontal axis 36 (FIG. 4) on the main frame 23. The wheels 34 are preferably spaced so that they roll on the soil generally in the same tracks made by the tractor wheels (see FIG. 3B). The gear boxes 31 and the cutter drums 28, 29 are attached in known manner to the decks 21, 22, by means of mountings 39, to position the cutter drums 28, 29 for rotation in generally horizontal planes about the shafts 30 (FIG. 8).

Figure 6:
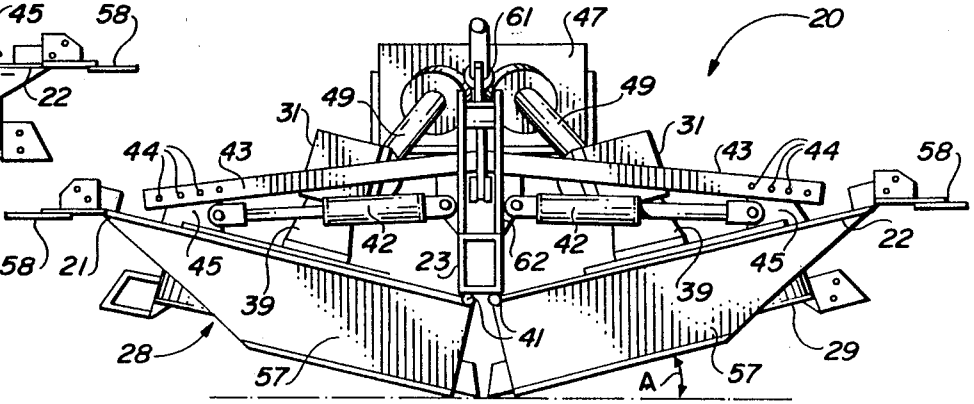
FIG. 6 is the same view as FIG. 5, with cutter decks in angled position.
Figure 5:
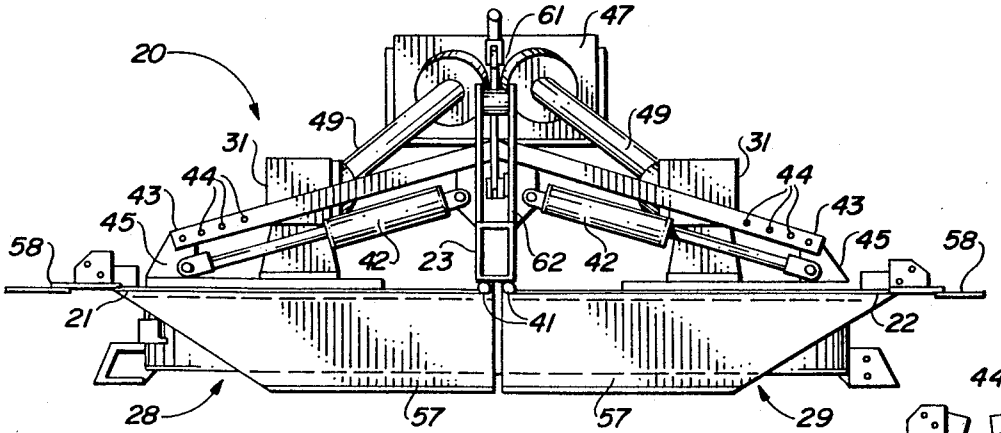
FIG. 5 is a rear section view taken through the line A—A of FIG. 4, with cutter decks in flat position.

Each deck 21, 22 is made angularly adjustable about multiple, longitudinally extending pins 41 which attach the decks 21, 22 to the frame 23 (See FIGS. 5 and 6). Hydraulic cylinders 42 are connected to extend transversely between elevated points of the frame 23 and outward points on the upper surfaces of the decks 21, 22, in accordance with well-known techniques, for hydraulic adjustment of the angling of the decks and cutter drums. Elongated locking flats 43, connecting areas of the frame and decks adjacent the same points, provide means for manually locking the decks to the frame at a selected hydraulically preset angle "A". In the configuration shown, the deck attachment end of each flat 43 is provided with a series of axially separated apertures 44, through a selected one of which a pin may be passed to lock the same to a vertical member 45 extending upwardly from the deck. In the preferred embodiment, the decks are made adjustable to bring them from the horizontal, aligned position (shown in FIG. 5), to a selected angled position (shown in FIG. 6) of angle "A" between 0° and 30°, to match furrow wall slopes of the same angles. The operating angle of cut "A" will normally be set at around 10°.

Figure 4:
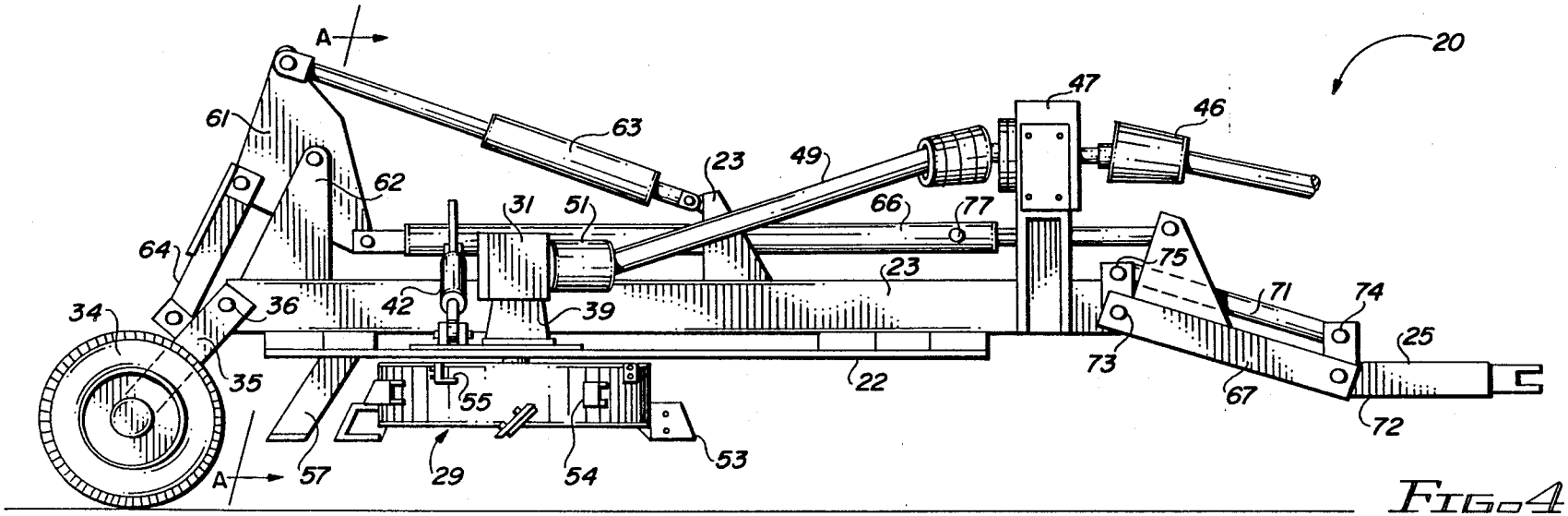
FIG. 4 is a side elevation view of an embodiment of the apparatus of the invention.
Figure 7:
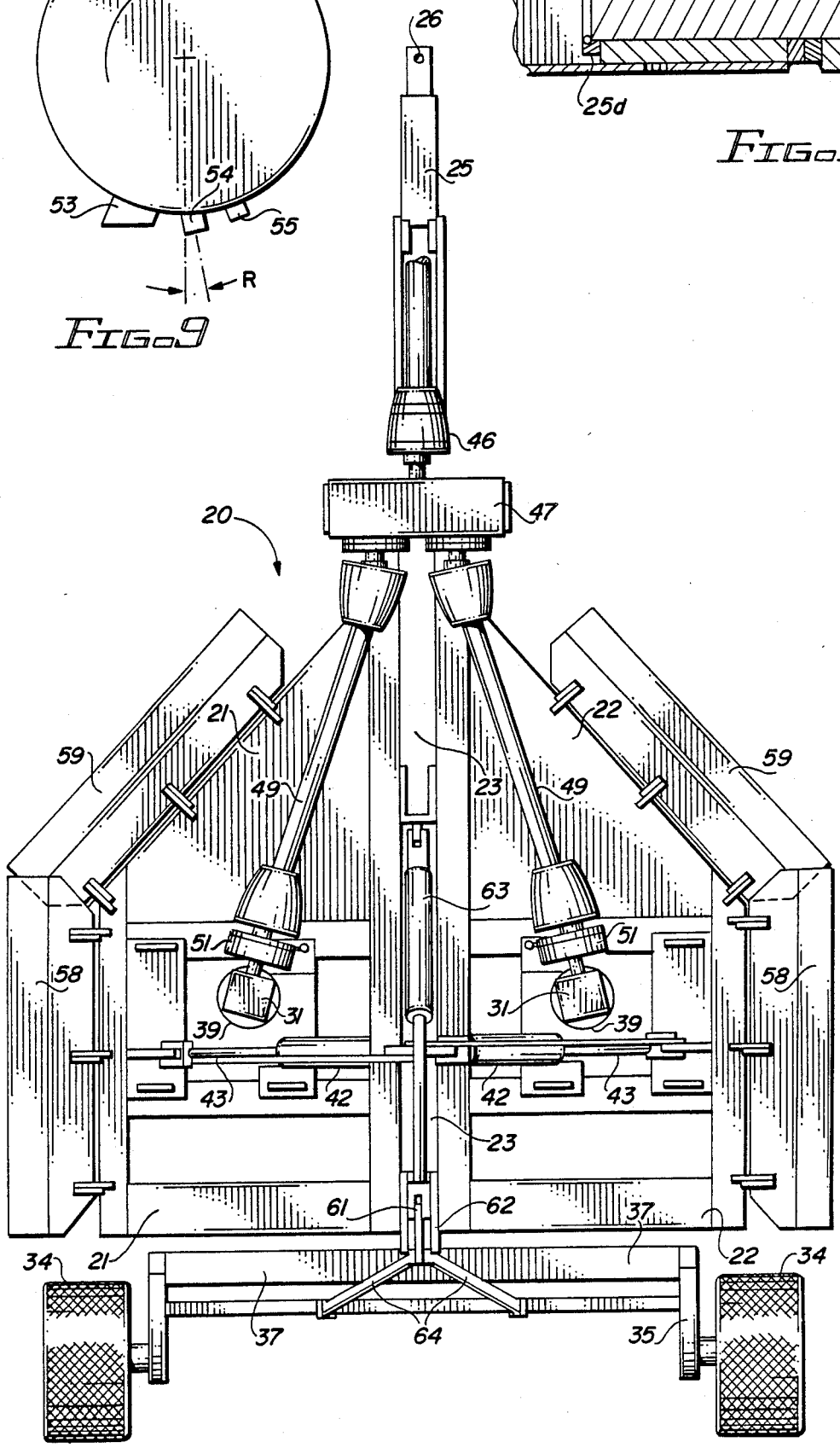
FIG. 7 is a top plan view of the apparatus of FIG. 4.

The drums 28, 29 are connected in known manner through the gear boxes 31 to be driven by power supplied from the tractor power take-off (PTO) unit through a universal telescoping drive shaft 46 (FIGS. 4 and 7). The drive shaft 46 is connected to the input shaft of a double output gear box 47, which has two outputs, each connected to further left and right universal telescoping drive shafts 49, the other ends of which are each connected to the gear boxes 31, which are 90° gear boxes. To absorb shock loads, slip clutches 51 are connected between the shafts 49 and the boxes 31.

The cutter drums 28, 29 are connected below the decks 21, 22 for counterrotation relative to each other. Opposite rotation of the drums acts in cooperation with the cutter configuration to discharge the cut material upwardly and laterally outwardly with respect to the direction of forward movement of the apparatus 20 (see severed material discharge directional arrows in FIGS. 3B and 8).

Figure 9:
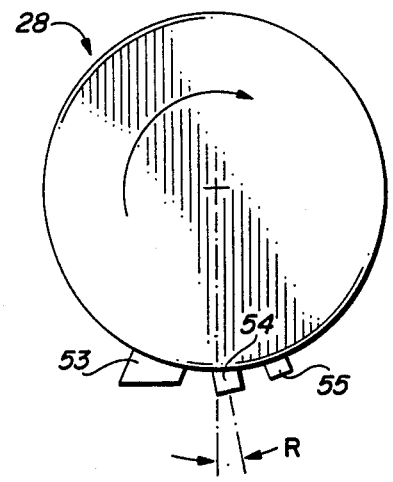
FIG. 9 is a schematic top view of the drum of FIG. 8.

Details of the cutter arrangement are shown in FIGS. 4, 8 and 9. As shown, each drum 28, 29 is circular and has a plurality of cutters or blades 53, 54, 55 extending outwardly peripherally of the drum that carries them. Each drum has three vertically-spaced tiers of cutters, each tier comprising four 90° angularly spaced cutters removably bolted to the outer wall of the drum.

The cutting elements comprise flat bars, as shown. The cutters of each tier are slightly angularly offset with respect to the cutters of the other tiers. The lower tier cutters 53 are set at an angle relative to the shaft axis 32 and are configured and positioned to cut into the ground laterally and lift the material up to the next tier. The center tier and upper tier cutters 54, 55 are arranged to eject the material outwardly to the sides of the apparatus 20.

As seen in FIG. 9, to assist centrifugal force to sling the material out from the drums, the cutters 54, 55 are angularly lagged by an angle "R" of about 10°, opposite the direction of rotation of the cutter from a radially aligned position. As shown in FIG. 8, the cutting orbits of drums 28, 29 are made overlapping to ensure cutting right to the center of the furrow 10.

A plate 57 (FIGS. 4–6) is fixedly attached at the rear of each deck 21, 22 to channel the cut soil out to the sides. Adjustable deflectors 58, 59 (FIG. 7) are pivotally mounted to the outer edges of the decks 21, 22 to direct the distance of travel of the expelled material. Manual angular adjustment means is provided to set the limits for the area over which the ejected material is deposited.

A bell crank 61 (FIG. 4) connected for horizontal pivoting about an upwardly projecting bracket 62 attached to the main frame 23 is attached at its upper region to a hydraulic cylinder 63. Links 64 connect an intermediate region of the bell crank 61 to the axle frame 35 (FIG. 7). Another link 66 (FIG. 4) connects between a lower region of the bell crank 61 and a tow bar link 67. The link 67 is in turn connected to the tow bar hitch 25.

Figure 10:
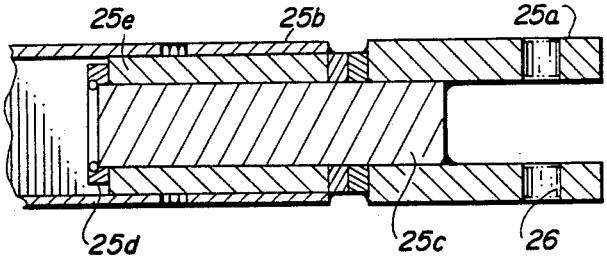
FIG. 10 is a section view of the tow bar hitch of the apparatus.

FIG. 10 gives details of the tow bar hitch 25 which has a forward end portion 25*a* attached to a rear tow bar portion 25*b* by a mechanism that permits relative axial rotation of the portions 25*a* and 25*b*. this is accomplished by means of a cylindrical pin 25*c* extension welded to the end portion 25*a* and movably received interiorly and axially within the portion 25*b*. Pin 25*c* is retained within the portion 25*b* by an expanded inner section 25*d* that is positioned rearwardly of a narrowed inside diameter section 25*e* of the portion 25*b*. This tow bar allows twisting between the tractor and the apparatus 20.

The tow bar 25 is attached to the main frame 23 by means of the lower link 67 and an upper link 71 (FIG. 4). The links 67, 71 pivot about horizontal pins 72, 73 and 74, 75 which attach the links to the main frame 23. When the piston of the cylinder 63 is extended, the entire assembly consisting of the main frame 23 and both decks 21, 22, is raised out of a ground engaging, operational position. Conversely, when the piston of cylinder 63 is retracted, the entire assembly is lowered. The cylinder 63 is connected to be controlled by hydraulic valves located close to the tractor operator.

To compensate for variations in draw bar elevation for different tractors, the connecting link 66 between the bell crank 61 and the tow bar link 67 is made longitudinally adjustable. The adjustment is accomplished by forming the link from two telescoping pieces and utilizing a removable pin 77 that can be placed through apertures in the outer telescoping member and into a corresponding selected one of a plurality of apertures formed in the inner telescoping member.

The apparatus and method thus described performs the furrow refurbishing operation in a single pass through the furrow, at a reasonable rate of speed, removing only the top layer of soil retaining vegetation, leaving most of the root structure intact. After the method has been applied, the refurbished furrow is clean, packed and smooth, and resultant erosion causing conditions are minimal. Since the root system is mostly intact, vegetation will grow back rapidly, thereby immediately protecting the furrow against erosion. This one pass system is, thus, highly beneficial, as well as providing cost and time savings.

It will be appreciated by those skilled in the art to which the invention relates that the foregoing detailed description is merely exemplary and not exclusive. In particular, it will be appreciated that other drum and cutter configurations and positioning, as well as other assemblies are possible to derive the benefits and advantages of the invention. It is, thus, intended that the invention be defined by the claims appended hereto and encompass all such substitutions and modifications to the described embodiments as may be made without departing from the spirit and scope of the invention.

What is claimed is:

1. A method for refurbishing shallow angle furrows formed in the spacing between adjacent beds of agricultural crops, the furrows having oppositely sloped side walls of angle 30° or less from horizontal, and having furrow wall edges, the method comprising, in a single pass of travel longitudinally of the furrow, simultaneously shaping both walls by cutting them laterally, parallel to the wall slopes by means of cutter blades mounted on drums and rotated about generally vertical axes, oriented perpendicular to the furrow walls, using planar cutting motions of the blades along paths parallel to the walls of the furrows; the cutter blades cutting into the ground laterally and, simultaneously therewith and following continuously thereupon, lifting the material thus cut from the walls and delivering the same upwardly and outwardly beyond the furrow wall edges and onto the beds.

2. A method as in claim 1, wherein the cutting is performed by drums mounted on opposing, angularly adjustable decks of a tractor-towed implement.

3. A method as in claim 1, for refurbishing furrows which have a growth of vegetation including root structure covering the walls to protect against wall erosion, the cutter blades cutting into the ground laterally, without cutting and displacing the root structure of the vegetative growth.

4. A method for refurbishing furrows formed in the spacing between adjacent beds of agricultural crops, the furrows having oppositely sloped side walls of angle less than 45° from horizontal, and having furrow wall edges, the method comprising, in a single pass of travel longitudinally of the furrow, simultaneously shaping both walls by cutting them laterally, parallel to the wall slopes; then, simultaneously therewith and following continuously thereupon, lifting material thus cut from the wall and delivering the same up and beyond the furrow wall edges; wherein the cutting is performed by cutter blades mounted on drums and rotated about generally vertical axes, oriented perpendicularly to the furrow walls; the cutter blades being arranged in vertically-spaced tiers on each drum, with the blades of each tier being angularly evenly-spaced about the associated drum, and the cutters of a particular tier being angularly offset relative to the corresponding cutters of an adjacent tier.

5. A method as in claim 4, wherein the blades are arranged in upper and lower tiers, with the blades of the lower tier being set at an angle relative to the vertical axis of the associated drum and being configured and arranged to cut into the ground laterally and lift the cut wall material up to the upper tier, and with the blades of the upper tier being set generally vertically and being configured and arranged to eject the cut material outwardly away from the associated drum.

6. Apparatus for refurbishing furrows formed in the spacing between adjacent beds of agricultural crops, the furrows having oppositely sloped left and right side walls of angle less than 45° from horizontal and having furrow wall edges, the apparatus comprising:

an elongated main support frame;

left and right decks oppositely supported on the frame;

left and right cutter drums;

left and right shafts, respectively supporting the drums relative to the decks for rotational movement about generally vertical rotary axes, respectively perpendicular to the slopes of the walls;

cutters mounted on the drums for making cuts laterally into material of the wall, parallel to the wall slopes; and means associated with the decks and the cutters for lifting the cut material and delivering the same up and beyond the furrow wall edges.

7. Apparatus as claim 6, further comprising means for relative angular adjustment of the decks and corresponding relative angular adjustment of the shafts, about a longitudinal axis of the frame centrally of the furrow, so that the same apparatus may be employed for different furrows having different angles of slope.

8. Apparatus as in claim 7, wherein the angular adjustment means comprises longitudinally extending pins which attach the decks to the frame.

9. Apparatus as in claim 6, further comprising means for towing the apparatus behind a tractor.

10. Apparatus as in claim 9, wherein the towing means comprises a tow bar hitch attached to a distal end of the frame; means for attaching the tow bar hitch to a tractor; and means for allowing twisting between the tractor and the tow bar.

11. Apparatus as in claim 10, wherein the means for allowing twisting comprises the tow bar hitch being formed of an elongated forward portion and an elongated rearward portion, a cylindrical pin extension attached to one of the forward and rearward portions and received interiorly and axially within the other of those portions, and means for retaining the extension within the other portion while allowing axial rotation thereof relative to the other portion.

12. Apparatus as in claim 9, further comprising means for selectively moving the apparatus, when towed by the tractor, between a ground engaging operational position and a raised position.

13. Apparatus as in claim 12, wherein said apparatus further comprises a transversely extending axle structure pivotally connected to a proximal end of the main support frame, and wheels mounted for rotary movement about the axle structure; wherein the towing means comprises a tow bar hitch, and linkage means connecting the tow bar hitch to a distal end of the support frame; and wherein the selectively moving means comprises an arm member pivotally connected to the frame inwardly of the axle frame, the arm being movable between retracted and extended positions, and bell crank means pivotally connected to the frame, the axle structure, the linkage means and the arm for moving the apparatus to the ground engaging position when the arm is brought into its retracted position and for moving the apparatus to the raised position when the arm is brought into its extended position.

14. Apparatus as in claim 13, wherein each deck has a rear and an outside edge, and further comprising a plate depending from the rear edge of each deck to channel the cut material out to the left and right, respectively, of the decks, and an adjustable deflector pivotally mounted to the outside edge of each deck to control the expulsion of the cut material beyond the decks.

15. Apparatus as in claim 6, wherein the cutters are arranged in vertically-spaced tiers on each drum, with the blades of each tier being angularly evenly-spaced about the associated drum, and the cutters of a particular tier being angularly offset relative to the corresponding cutters of an adjacent tier.

16. Apparatus as in claim 15, wherein the cutters are arranged in upper and lower tiers, with the cutters of the lower tier being set at an angle relative to the shaft axis of the associated drum and being configured and arranged to cut into the ground laterally and lift the cut wall material up to the upper tier, and with cutters of the upper tier being set generally vertically and being configured and arranged to eject the cut material outwardly away from the associated drum.

17. Apparatus as in claim 16, wherein the cutters of the upper tier are angularly lagged outwardly from the associated drum by an angle opposite the direction of drum rotation of about 10° from a radially aligned position, so as to assist centrifugal force to sling the cut material outward away from the drum.

* * * * *

US004887372B1

REEXAMINATION CERTIFICATE (2133rd)

United States Patent [19]

Block

[11] B1 4,887,372

[45] Certificate Issued Nov. 16, 1993

[54] SHALLOW ANGLE FURROW REFURBISHING METHOD AND APPARATUS

[75] Inventor: Donald P. Block, Clermont, Fla.

[73] Assignee: Orange Service Company, Inc., Orlando, Fla.

Reexamination Request:
No. 90/002,849, Sep. 22, 1992

Reexamination Certificate for:

| | |
|---|---|
| Patent No.: | **4,887,372** |
| Issued: | **Dec. 19, 1989** |
| Appl. No.: | **230,027** |
| Filed: | **Aug. 9, 1988** |

[51] Int. Cl.[5] ..... E02F 5/08

[52] U.S. Cl. ..... 37/91; 172/49.5; 37/365; 37/195

[58] Field of Search ..... 37/91, 81, 80 A, 82, 37/99, 189

[56] References Cited

U.S. PATENT DOCUMENTS

| | | | |
|---|---|---|---|
| 4,535,555 | 8/1985 | Petraud | 37/94 |

FOREIGN PATENT DOCUMENTS

| | | | |
|---|---|---|---|
| 906208 | 8/1972 | Canada | 37/189 |
| 3130167 | 2/1983 | Fed. Rep. of Germany | 37/1 |
| 171191 | 6/1965 | U.S.S.R. | 37/91 |
| 174995 | 11/1965 | U.S.S.R. | 37/91 |
| 264998 | 6/1970 | U.S.S.R. | 37/91 |
| 269021 | 8/1970 | U.S.S.R. | 37/80 A |
| 318663 | 1/1972 | U.S.S.R. | 37/80 A |
| 377490 | 6/1973 | U.S.S.R. | 37/80 A |
| 562623 | 9/1977 | U.S.S.R. | 37/80 A |
| 899784 | 1/1982 | U.S.S.R. | 37/189 |
| 1104209 | 7/1984 | U.S.S.R. | 37/91 |
| 1599485 | 10/1990 | U.S.S.R. | 37/91 |

OTHER PUBLICATIONS

Cerimon Ditcher Sales Literature.

*Primary Examiner*—Randolph A. Reese

[57] ABSTRACT

Shallow angle furrows between crop beds are reshaped and cleaned in one pass using a tractor-towed implement having angularly even-spaced cutter blades mounted in tiers on drums for rotation about generally vertical axes, perpendicular to the furrow walls on opposing, angularly adjustable decks. The blades of the lower tier are angled to cut into the wall material laterally, parallel to the wall slope, without destroying the root structure of protective sod covering. The cut material is lifted up to the upper tier blades which are offset and lagged so as to eject the cut material up and beyond the furrow wall edges following cutting, in one continuous operation. Plates and pivotal deflectors mounted at the edges of the decks, direct the discharge of cut material. A bell crank and pivotal linkage provides for hydraulically assisted raising and lowering of the apparatus from and into ground contact.

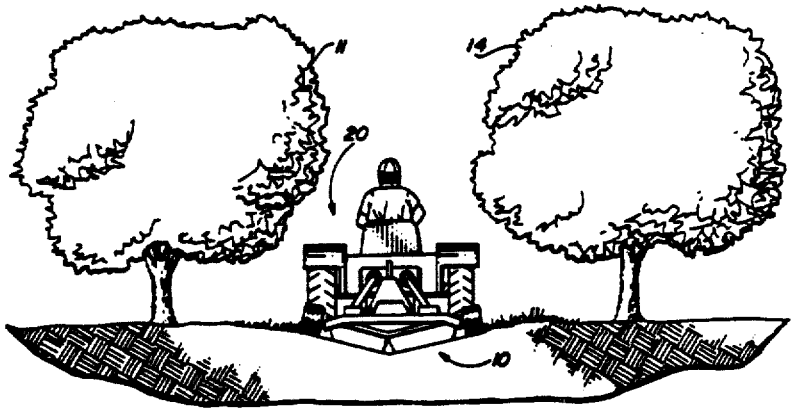

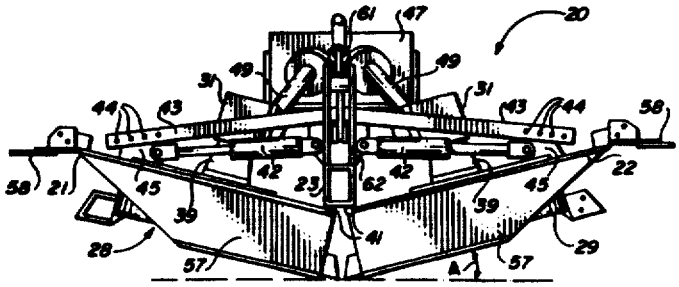

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 6–17 are confirmed.

Claims 1, 4 and 5 are determined to be patentable as amended.

Claims 2 and 3, dependent on an amended claim, are determined to be patentable.

1. A method for refurbishing shallow angle furrows formed in the spacing between adjacent beds of agricultural crops[,]; the furrows *being V-shaped channels* having oppositely sloped side walls of angle 30° or less from horizontal, *converging at a furrow center* and having furrow wall edges[,]; the method comprising, in a single pass of travel longitudinally of the furrow, simultaneously shaping *the center and* both walls by cutting [them] *the walls* laterally, parallel to the wall slopes by means of cutter blades mounted on drums *supported on opposing decks* and rotated about generally vertical axes, oriented perpendicular to the furrow walls, using planar cutting motions of the blades along paths parallel to the walls of the furrows; the cutter blades cutting into the ground laterally and, simultaneously therewith and following continuously thereupon, lifting the material thus cut from the walls, [and] delivering the same upwardly and outwardly beyond the furrow wall edges *under channeling by the decks*, and *dispersing it widely* onto the beds.

4. A method for refurbishing furrows formed in the spacing between adjacent beds of agricultural crops[,]; the furrows *being V-shaped channels* having oppositely sloped side walls of angle less than 45° from horizontal, *converging at a furrow center* and having furrow wall edges[,]; the method comprising, in a single pass of travel longitudinally of the furrow, simultaneously shaping *the center and* both walls by cutting [them] *the walls* laterally, parallel to the wall slopes; then, simultaneously therewith and following continuously thereupon, lifting material thus cut from the wall and delivering the same up and beyond the furrow wall edges; wherein the cutting is performed by cutter blades mounted on drums *supported on opposing decks* and rotated about generally vertical axes, oriented [perpendicularly] *perpendicular* to the furrow walls; the cutter blades being arranged in vertically-spaced *upper and lower* tiers on each drum, with the blades of [each] *the lower* tier [being angularly evenly-spaced about the associated drum, and the cutters of a particular tier being angularly offset relative to the corresponding cutters of an adjacent tier] *cutting into the ground laterally and lifting the cut wall material up to the upper tier, and with the blades of the upper tier ejecting the cut material outwardly away from the associated drum; and wherein the decks channel the soil ejected outwardly by the upper tier and control the distance the ejected material travels.*

5. A method as in claim 4, wherein the blades *of each tier* are [arranged in upper and lower tiers, with the blades of the lower tier being set at an angle relative to the vertical axis of the associated drum and being configured and arranged to cut into the ground laterally and lift the cut wall material up to the upper tier, and with the blades of the upper tier being set generally vertically and being configured and arranged to eject the cut material outwardly away from the associated drum] *angularly evenly-spaced about the associated drum and the blades of one tier are angularly offset relative to the corresponding blades of the other tier.*

* * * * *